US010077594B2

(12) United States Patent
Fingerle

(10) Patent No.: US 10,077,594 B2
(45) Date of Patent: Sep. 18, 2018

(54) FITTING FOR PRESSING A SLIDING WING ONTO A FIXED ENCLOSURE

(71) Applicant: ROTO FRANK AG, Leinfelden-Echterdingen (DE)

(72) Inventor: Stefan Fingerle, Rommelsbach (DE)

(73) Assignee: Roto Frank AG, Leinfelden-Echterdingen (DE)

( * ) Notice: Subject to any disclaimer, the term of this patent is extended or adjusted under 35 U.S.C. 154(b) by 0 days.

(21) Appl. No.: 14/898,238

(22) PCT Filed: Jul. 11, 2014

(86) PCT No.: PCT/EP2014/064911

§ 371 (c)(1),
(2) Date: Dec. 14, 2015

(87) PCT Pub. No.: WO2015/010925

PCT Pub. Date: Jan. 29, 2015

(65) Prior Publication Data

US 2016/0145932 A1 May 26, 2016

(30) Foreign Application Priority Data

Jul. 22, 2013 (EP) ..... 13177345

(51) Int. Cl.
*E06B 3/46* (2006.01)
*E05D 15/10* (2006.01)
(Continued)

(52) U.S. Cl.
CPC ..... *E06B 3/46* (2013.01); *E05B 17/0025* (2013.01); *E05B 65/087* (2013.01); *E05C 9/063* (2013.01);
(Continued)

(58) Field of Classification Search
CPC . E06B 3/46; E06B 1/04; E06B 3/4627; E06B 3/4645; E05B 17/0025;
(Continued)

(56) References Cited

U.S. PATENT DOCUMENTS 3,056,176 A * 10/1962 Soddy ..... B61D 19/009 16/96 R
3,660,936 A 5/1972 Bryson
(Continued)

FOREIGN PATENT DOCUMENTS

CN 101068997 11/2007
CN 101146977 3/2008
(Continued)

*Primary Examiner* — Katherine W Mitchell
*Assistant Examiner* — Ave Massad
(74) *Attorney, Agent, or Firm* — Collard & Roe, P.C.

(57) ABSTRACT

A displacement arrangement for displacing a sliding leaf of a window or a door relative to a fixed surround of the window or the door in a direction which is transverse relative to a main plane of the window or the door includes an actuation mechanism arranged on the leaf that is movable with at least one portion in a circumferential direction of a rebate, a first control element arranged on the portion of the actuation mechanism and a second control element arranged on a guiding member, where the guiding member is guided on a fixed surround and arranged on the leaf to be movable transversely relative to the circumferential direction of the rebate.

12 Claims, 5 Drawing Sheets

(51) Int. Cl.

| | |
|---|---|
| ***E05B 65/08*** | (2006.01) |
| ***E05C 9/06*** | (2006.01) |
| ***E05B 17/00*** | (2006.01) |
| ***E06B 1/04*** | (2006.01) |

(52) U.S. Cl.
CPC ..... *E05D 15/10* (2013.01); *E06B 1/04* (2013.01); *E05D 2015/1026* (2013.01); *E05D 2015/1028* (2013.01); *E05D 2015/1039* (2013.01); *E05Y 2201/692* (2013.01); *E05Y 2600/56* (2013.01); *E05Y 2800/12* (2013.01); *E05Y 2800/742* (2013.01)

(58) Field of Classification Search
CPC ..... E05B 65/087; E05D 15/10; E05D 2015/1028; E05D 2015/1026; E05D 2015/1039
See application file for complete search history.

(56) References Cited

U.S. PATENT DOCUMENTS

| | | | | | |
|---|---|---|---|---|---|
| 4,341,043 | A * | 7/1982 | Yamamoto | E06B 7/18 | 49/209 |
| 4,688,352 | A * | 8/1987 | Kinoshita | E05D 15/10 | 49/209 |
| 5,012,611 | A * | 5/1991 | Hsu | E06B 7/18 | 49/225 |
| 5,542,213 | A * | 8/1996 | Freeman | E05D 15/10 | 49/220 |
| 5,836,111 | A * | 11/1998 | Tak | E05D 15/10 | 49/176 |
| 6,135,511 | A * | 10/2000 | Smith | E05C 9/063 | 292/139 |
| 6,497,072 | B2 * | 12/2002 | Fries | E05B 65/08 | 49/146 |
| 7,845,116 | B2 | 12/2010 | Masuda | | |
| 7,971,392 | B2 | 7/2011 | Seo | | |
| 2007/0052247 | A1 * | 3/2007 | Timothy | E05C 9/063 | 292/141 |
| 2009/0038228 | A1 * | 2/2009 | Lee | E05D 15/1042 | 49/360 |
| 2013/0118086 | A1 * | 5/2013 | Halfon | E05D 15/10 | 49/360 |
| 2016/0130847 | A1 * | 5/2016 | Gramstad | E05C 9/1833 | 49/394 |

FOREIGN PATENT DOCUMENTS

| | | |
|---|---|---|
| CN | 103168144 | 6/2013 |
| FR | 2294312 | 7/1976 |
| JP | 2007303109 | 11/2007 |
| WO | WO99/60239 | 11/1999 |
| WO | WO2007/075075 | 7/2007 |

* cited by examiner

FITTING FOR PRESSING A SLIDING WING ONTO A FIXED ENCLOSURE

CROSS-REFERENCE TO A RELATED APPLICATION

The invention described and claimed hereinbelow is a National Stage Application of PCT/EP2014/064911, filed on Jul. 11, 2014 (the PCT application), which is filed in the United States under 35 USC §371. The PCT application is incorporated herein by reference and provides the basis for a claim for priority of invention.

BACKGROUND OF THE INVENTION

The invention relates to a displacement arrangement for displacing a leaf, in particular a sliding leaf, of a window, a door or the like relative to a fixed surround of the window or the door in a direction which is transverse, in particular perpendicular, relative to the main plane of the window or the door, having an actuation mechanism which can be arranged on the leaf and which can be moved with at least one portion in the circumferential direction of the rebate and having a first control element which is arranged on the portion of the actuation mechanism, and having a second control element which is arranged on a guiding member and which is intended to be guided on the fixed surround and to be arranged on the leaf so as to be able to be moved transversely relative to the circumferential direction of the rebate, wherein one of the control elements is constructed as a control contour which extends at least partially transversely relative to the circumferential direction of the rebate and one of the control elements is constructed as a control projection which cooperates with the control contour.

Such a displacement arrangement is known, for example, from WO 2007/075075 A1.

Sliding doors and sliding windows involve the problem of sealing the sliding leaf with respect to the fixed surround, in particular a fixed frame. If a seal is arranged between the fixed surround and the sliding leaf, and the sliding leaf cannot be displaced transversely relative to the main plane of the window or the door, the sliding leaf can be opened only with great difficulty since it is impeded by the seal which is arranged between the leaf and fixed surround.

In order to facilitate the opening and closing of the leaf, it is therefore intended to be able to be moved away perpendicularly relative to the main plane of the window or the door in order to be able to be displaced in a manner unimpeded by the seal. In order to bring about this transverse displacement, WO 2007/075075 A1 proposes, using an oblique slot in a drive rod and a bolt which engages in the oblique slot and which is arranged on a carriage, that a leaf be moved transversely relative to the main leaf plane relative to a carriage.

If this arrangement is used to press the leaf against a seal, not inconsiderable forces acting on the carriage are produced. This may lead to damage or tilting of the rollers of the carriage.

SUMMARY OF THE INVENTION

An object of the present invention is therefore to provide a structurally simple displacement arrangement which prevents the above-mentioned disadvantages.

This object is achieved according to the invention with a displacement arrangement for displacing a leaf, in particular a sliding leaf, of a window, a door or the like relative to a fixed surround of the window or the door in a direction which is transverse, in particular perpendicular, relative to the main plane of the window or the door, having an actuation mechanism which can be arranged on the leaf and which can be moved with at least one portion in the circumferential direction of the rebate, and having a first control element which is arranged on the portion of the actuation mechanism, and having a second control element which is arranged on a guiding member and which is intended to be guided on the fixed surround and to be arranged on the leaf so as to be able to be moved transversely relative to the circumferential direction of the rebate, wherein one of the control elements is constructed as a control contour which extends at least partially transversely relative to the circumferential direction of the rebate and one of the control elements is constructed as a control projection which cooperates with the control contour, wherein the guiding member has a roller which can be rotated about a rotation axis orientated perpendicularly to the circumferential direction of the rebate and parallel with the main plane of the window or the door and which is supported on a surround portion when the displacement arrangement is mounted.

When the leaf is displaced relative to the fixed surround parallel with the main plane of the window or the door, the guiding member has to move relative to the fixed surround. If a rotatable roller is arranged on the guiding member, the forces required to displace the leaf can be kept small and the wear on the guiding member can be minimised since the roller can roll on the fixed surround. In this instance, the roller can be guided in a groove-like guide of the fixed surround or on a guide, in particular of a guiding rail which is orientated parallel with the main plane of the window or the door. When the actuation mechanism is actuated, the control projection and the control contour are moved relative to each other. As a result of the fact that the control contour is orientated obliquely or transversely relative to the circumferential direction of the rebate, this means that the guiding member is moved relative to the actuation mechanism which is arranged on the leaf. However, since the guiding member is guided on the fixed surround, this means that the leaf is moved relative to the fixed surround and can consequently be positioned on a seal. In contrast to the prior art, however, all the forces transverse relative to the circumferential direction of the rebate are taken up by the roller of the guiding member. The pressure on rollers which may optionally be arranged on the guiding member is thereby reduced.

The control contour may, for example, be constructed as a bent or curved control slot. The control projection may, for example, be constructed as a bolt which is arranged on a drive rod of a drive rod fitting, wherein the drive rod is a component of the actuation mechanism. In principle, however, it is also conceivable, for example, to provide a control slot in a drive rod and accordingly to arrange a bolt on the guiding member.

In particular, the guiding member may cooperate with a ground sill. A displacement of the guiding member to the leaf therefore leads to a displacement of the leaf transversely relative to the main plane of the window or the door. In this manner, it is, for example, possible to clamp a seal between the leaf and the fixed surround. Preferably, the guiding member can be displaced only transversely relative to the circumferential direction of the rebate relative to the leaf. In particular, the guiding member is preferably blocked on the leaf in the circumferential direction of the rebate so that it cannot move relative to the leaf in the circumferential direction of the rebate.

Particular advantages are afforded when the guiding member is guided on the leaf. A defined movement of the guiding member is thereby produced relative to the leaf. Furthermore, as a result of the guiding, it is possible to prevent the guiding member from moving relative to the leaf in the circumferential direction of the rebate. The guiding member may be arranged directly on the leaf or arranged on a leaf securing member which can be secured to a leaf. The guiding member may be guided on the leaf or on the leaf securing member. It is particularly preferable for the leaf securing member to have at least one transverse guide for the guiding member. As a result of the transverse guide, the movement of the guiding member relative to the leaf securing member is determined. Furthermore, as a result of the transverse guiding, it can be ensured that the guiding member can be moved exclusively transversely, in particular perpendicularly, relative to the main plane of the leaf and in particular cannot be moved in the circumferential direction of the rebate.

It is particularly preferable for at least one transverse guide to be constructed at least partially in dovetail-like form. Accordingly, the guiding member preferably has a dovetail-like construction which cooperates with the transverse guide and which is adapted thereto. As a result of the dovetail-like construction of the transverse guide, there is produced a stable connection of the leaf securing member and the guiding member. In particular, it is thereby possible to prevent the guiding member from tilting relative to the leaf securing member. The leaf securing member may have a securing opening in the region of the dovetail-like guide. Consequently, the leaf securing member may be screwed to the leaf frame in the region of the dovetail-like guide. This contributes to the stability of the displacement arrangement. In particular, it is thereby possible to prevent the leaf securing member from tilting relative to the leaf frame. The leaf securing member can consequently be secured to the leaf frame at a location where the highest loading is to be anticipated for the leaf securing member.

The leaf securing member may have a longitudinal slot which is orientated in the circumferential direction of the rebate and through which the control projection protrudes. It is thereby possible to arrange the leaf securing member and the guiding member directly in the region of the actuation mechanism and not, for instance, so as to be offset relative thereto.

According to an advantageous embodiment of the invention, there may be provision for the leaf securing member to at least partially engage behind the guiding member. The guiding member is thereby securely retained on the leaf securing member. The guiding member is further guided on the leaf securing member when it is partially engaged behind.

There may be arranged on the guiding member at least one roller, via which the leaf of the window, the door or the like can be supported on a running rail. In particular, a carriage may be arranged on the guiding member. As a result of the fact that the guiding member is supported transversely relative to the main plane of the window or the door on the fixed surround, transverse forces on the roller are prevented.

According to a development, there may be provision for there to be provided on the guiding member a roller arrangement which is arranged in the region of the roller so as to be able to be pivoted about a horizontal axis which is orientated transversely relative to the circumferential direction of the rebate, In this instance, the roller arrangement preferably has two rollers which are located at the two sides of the pivot axis. It can consequently be ensured that both rollers are constantly in contact with a running rail, even when either the leaf frame strut or the running rail are not precisely straight.

Other advantages are afforded when the roller arrangement is arranged on the guiding member with play in the transverse direction of the rebate. Undesirable forces on the rollers can also thereby be prevented. The easy running of the sliding leaf is thereby improved.

The guiding member may be preassembled with the leaf securing member, wherein the relative position of the guiding member and the leaf securing member, is fixed by a fixing element. The assembly of the displacement arrangement is thereby facilitated. During the first transverse displacement of the leaf, the fixing element can be released or even destroyed. As a result of the fixing element, the guiding member and the leaf securing member can be retained on each other in a non-releasable manner.

In principle, it is conceivable for a Bowden cable to be used as an actuation mechanism. However, advantages are afforded when a circumferential drive rod fitting is provided as an actuation mechanism. The drive rod fitting preferably extends over at least the majority of the circumference of the leaf.

The scope of the invention further includes a window, a door or the like having a fixed surround, a leaf and a displacement arrangement according to the invention. A window which is constructed in this manner or a door which is constructed in this manner, or the like, may be sealed in a particularly reliable manner.

To this end, it is advantageous for there to be provided a circumference seal which is clamped between the leaf and fixed surround in the event of a transverse displacement of the leaf. In this instance, the seal may be arranged either on the fixed surround or on the leaf. The seal is in this instance preferably arranged at the side of the fixed surround facing the leaf or at the side of the leaf facing the fixed surround.

Particular advantages are afforded when a plurality of guiding members are provided. In this instance, a roller or roller arrangement may be provided on at least two guiding members. At the locations at which the guiding members are provided, closure locations are produced. However, these closure locations have no closure pieces. Unsightly visible closure pieces can therefore be avoided with the displacement arrangement according to the invention. As a result of the fact that it is possible to dispense with closure pieces, an even passageway or an even ground sill can also be ensured. Occurrences of stumbling can be prevented.

In principle, it is possible to provide as many guiding members as desired. Preferably, a plurality of guiding members are provided at the top and at the bottom so as to be distributed over the length of the leaf.

Other features and advantages of the invention will be appreciated from the following description of an embodiment of the invention, with reference to the Figures of the drawings which show details which are significant to the invention, and from the claims. The individual features can be implemented individually per se or together in any combination in a variant of the invention.

BRIEF DESCRIPTION OF THE DRAWINGS

A preferred embodiment of the invention is schematically illustrated in the drawings and is explained in greater detail below with reference to the Figures of the drawings, in which.

DETAILED DESCRIPTION OF THE INVENTION

Figure 1:
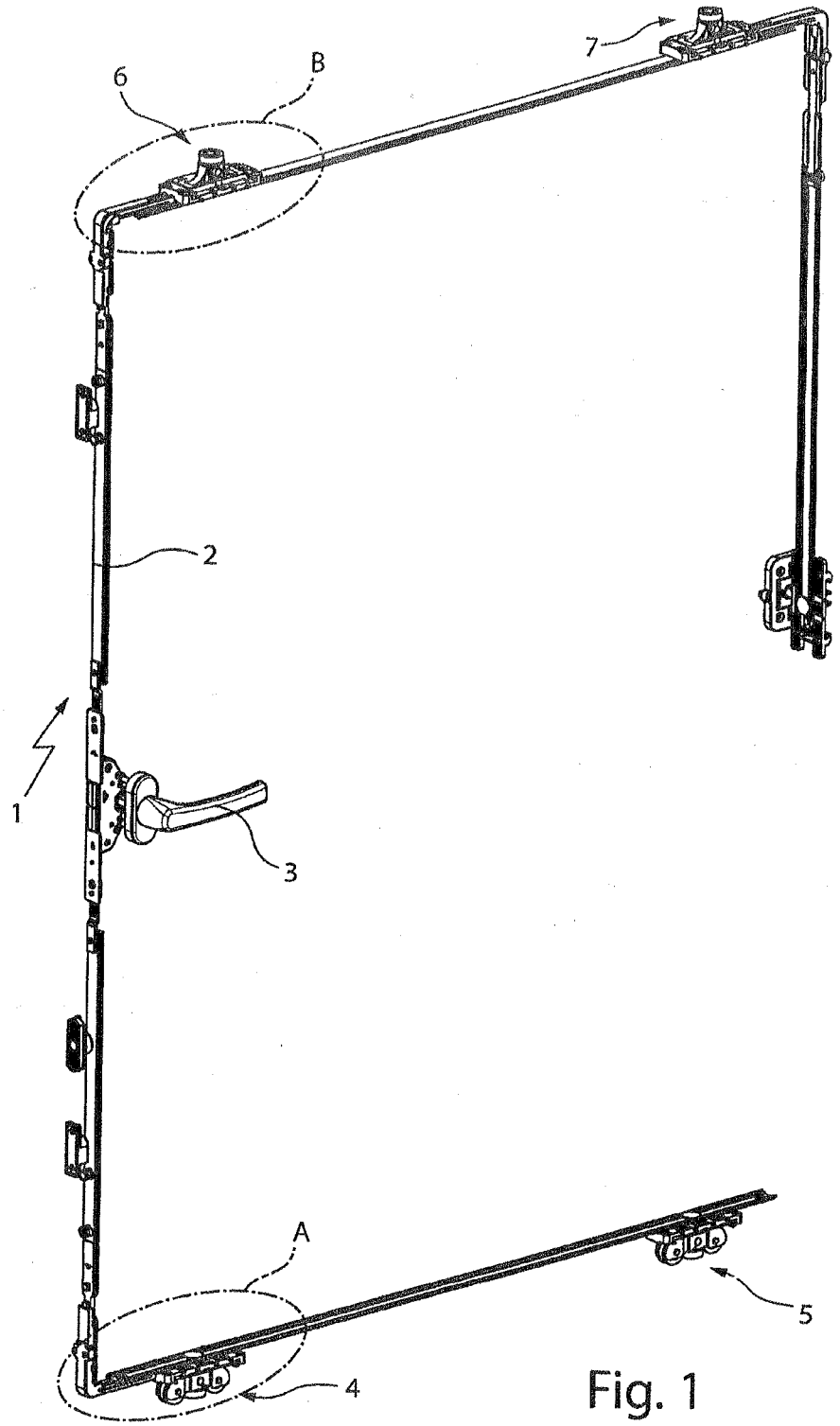
FIG. 1 is a perspective view of a displacement arrangement.

FIG. 1 shows a displacement arrangement 1 having an actuation mechanism 2 which is constructed as a circumferential drive rod fitting and which can be actuated by means of an actuation handle 3. The actuation mechanism 2 is mounted on a leaf of a window or door which is not illustrated in this instance and extends in the circumferential direction of the rebate. In the embodiment shown, the displacement arrangement has four locations 4 to 7 on which a guiding member can be displaced transversely relative to the circumferential direction of the rebate with respect to a leaf or with respect to the actuation mechanism 2.

Figure 2:
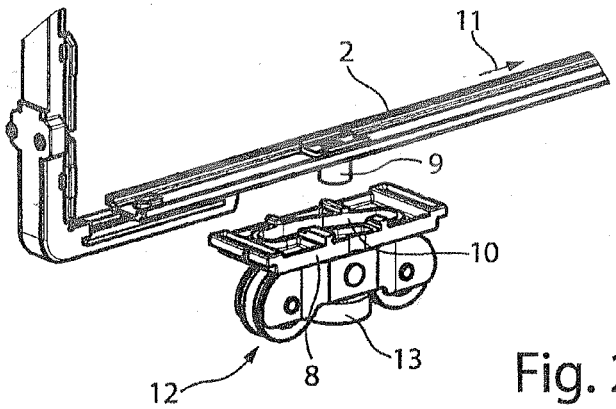
FIG. 2 is an enlarged view of the detail A of FIG. 1.

In the enlarged illustration of the detail A in FIG. 2, the guiding member 8 is illustrated without a leaf securing member which is arranged between the guiding member 8 and actuation mechanism 2. It can be seen that the actuation mechanism 2 has a control element 9 which is constructed as a control projection and which can engage in a control element 10 of the guiding member 8, which control element is constructed as a control contour, in particular a control slot. In this instance, the control slot is orientated obliquely relative to the circumferential direction of the rebate 11. When the actuation mechanism 2 is displaced in the circumferential direction of the rebate 11, the guiding member 8 is thus displaced perpendicularly relative to the circumferential direction of the rebate 11 relative to the actuation mechanism 2 and consequently the leaf.

The guiding member 8 of FIG. 2 has a roller arrangement 12 which will be further described in greater detail below. Below the roller arrangement 12, it is possible to see a roller 13 which can be rotated about a rotation axis which is orientated perpendicularly relative to, the circumferential direction of the rebate 11 and parallel with the main plane of a door or a window. The roller 13 has a diameter which is greater than the width of the carriage arrangement 12. In cooperation with a fixed surround, it is thereby possible to prevent transverse forces from acting on the roller arrangement 12.

Figure 3:
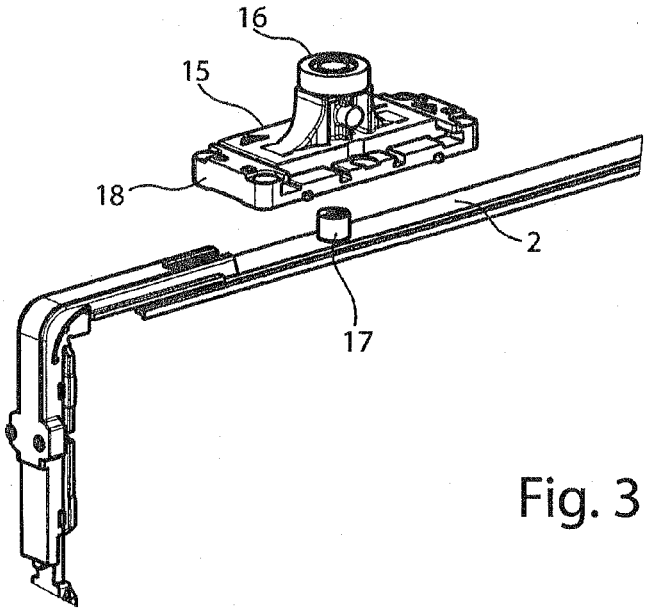
FIG. 3 is an enlarged view of the detail B of FIG. 1.

FIG. 3 is an exploded view of the detail B of FIG. 1. The guiding member 15 also has a roller 16 which is rotatably arranged about a vertical rotation axis. The rotation axis of the roller 16 is consequently also orientated perpendicularly relative to the circumferential direction of the rebate 11 and parallel with the main plane. The roller 16 is intended to cooperate with a fixed surround. The guiding member 5 has no carriage arrangement. There is again provided a control element 17, which is constructed as a control projection, opposite the guiding member 15 and arranged on the actuation mechanism 2. In particular, the control projection may be constructed as a roller which is arranged on a drive rod. The control element 17 engages through a leaf securing member 18 on which the guiding member 15 is displaceably arranged transversely relative to the circumferential direction of the rebate 11. The control element 17 engages in a control element 10 of the guiding member 15.

Figure 4:
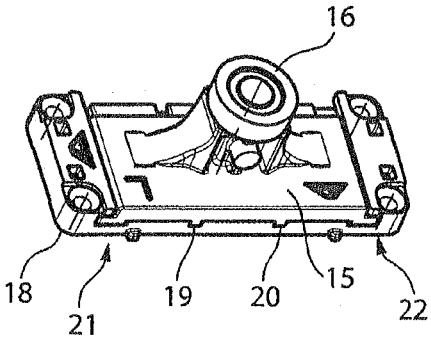
FIG. 4 is a perspective view of a guiding member which is arranged on a leaf securing member.

In the slightly enlarged perspective view of the guiding element 15 according to FIG. 4, it can be seen that the leaf securing member 18 has transverse guides 19, 20 along which the guiding member 15 can be displaced relative to the leaf securing member 18. It can further be seen that the leaf securing member 18 overlaps the guiding member 15 in the regions 21, 22. The guiding member 15 is thereby retained on the leaf securing member 18.

Figure 5:
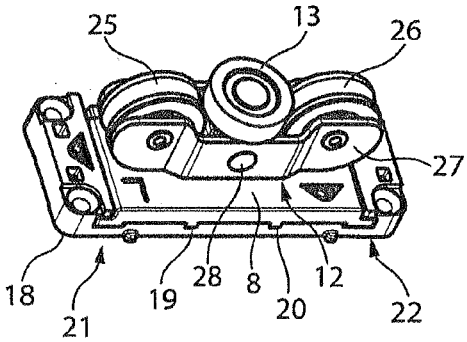
FIG. 5 is a perspective view of a guiding member which has a roller arrangement and which is arranged on a leaf securing member.

FIG. 5 shows the guiding member 8 in an illustration which corresponds to FIG. 4. The arrangement of FIG. 5 corresponds to the arrangement of FIG. 4 with the exception that a roller arrangement 12 is arranged on the guiding member 8. The roller arrangement 12 has two rollers 25, 26 which are rotatably arranged on a roller retention member 27. The roller retention member 27 itself is pivotably connected to the guiding member 8 via a rotation axis 28. This means that the roller arrangement 12 is arranged so as to be able to be pivoted in a limited manner about the pivot axis 28. Occurrences of unevenness of a running rail or curvatures of a leaf strut can thereby be compensated for. In a direction parallel with the pivot axis 28, the roller arrangement 12 is supported with little play, in particular in the region of from 5/10 to 8/10 mm. Consequently, a slight adjustment of the roller arrangement 12 transversely relative to the guiding member 8 is also possible. Loads on the rollers 25, 26 can thereby be kept low. It can again be seen that the diameter of the roller 13 is greater than the width of the roller arrangement 12.

Figure 6:
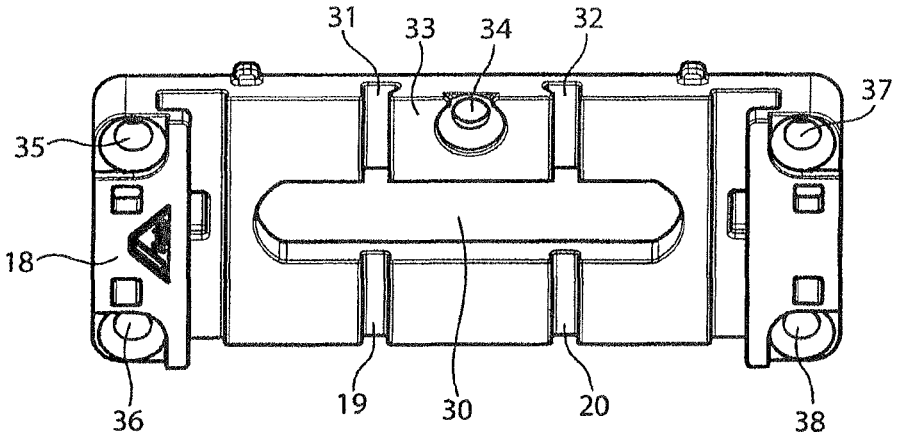
FIG. 6 is a view of a leaf securing member.

FIG. 6 shows a leaf securing member 18 which can be used both in the arrangement according to FIG. 5 and in the arrangement according to FIG. 4. It can be seen that the leaf securing member 18 has a linear longitudinal slot 30 through which the control element 9 or 17 can protrude, respectively, in order to move into engagement with the control element 10. The transverse guides 19, 20 can also be seen. The transverse guides 31, 32 are configured in such a manner that there is produced between them a region 33 which has a dovetail-like cross-section. The region 33 in turn constitutes a transverse guide for the guiding members 8, 15. As a result of the dovetail-like configuration, tilting of the guiding members 8, 15 relative to the leaf securing member 18 can be prevented. In the region of the transverse guide 33, a securing opening 34 is provided. Through the securing opening 34, a screw can be screwed into the leaf frame. Other securing openings 35-38 can also be seen.

Figure 7:
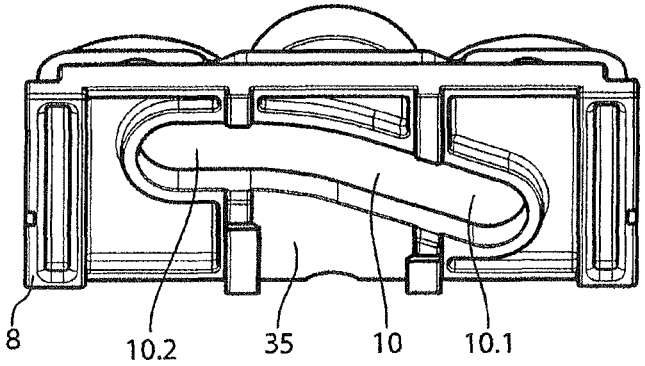
FIG. 7 is a view of the guiding member of FIG. 5.

FIG. 7 is a view of the guiding member 8. In this instance, it can be seen that the control element 10 has two portions 10.1, 10.2 which are orientated differently with respect to the circumferential direction of the rebate. In particular, the portion 10.1 has a larger angle with respect to the circumferential direction of the rebate or longitudinal direction of the leaf portion 8 than the portion 10.2. As a result of the portion 10.1, a larger transverse movement of the leaf can be carried out, whilst as a result of the portion 10.2 a gentle pressure of the leaf on a seal can be ensured. The transverse guide 33 of the leaf securing member 18 is guided in the region 35 of the guiding member 8.

Figure 8A:
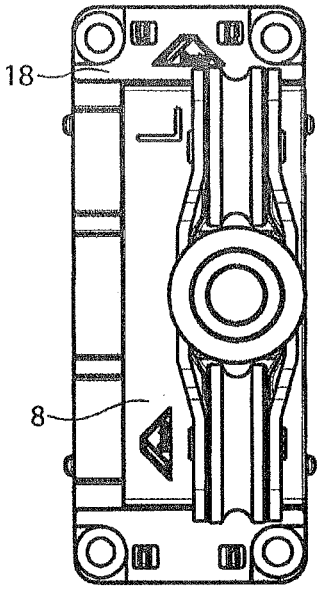
FIG. 8*a* is a view from below of a guiding member in the closure position.
Figure 9A:
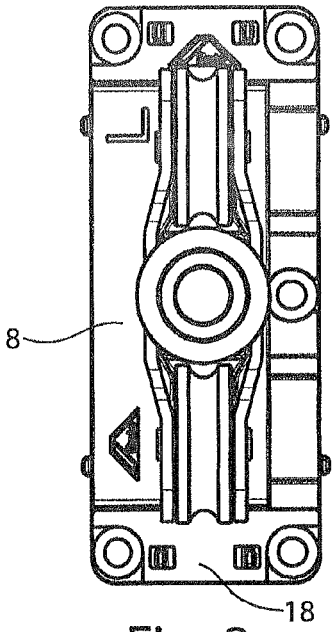
FIG. 9*a* is an illustration corresponding to FIG. 8*a* in a sliding position.
Figure 8B:
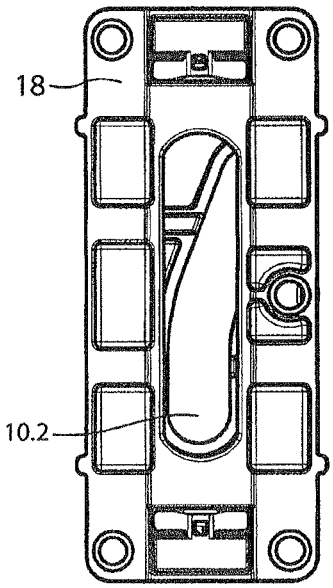
FIG. 8*b* is a plan view of the leaf securing member in a closure position.
Figure 9B:
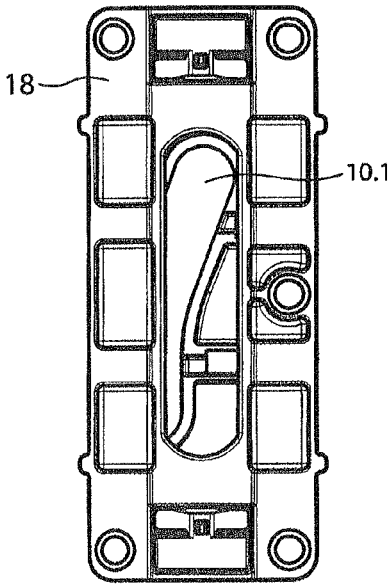
FIG. 9*b* is an illustration corresponding to FIG. 8*b* in a sliding position.

FIG. 8*a* is a view of the guiding member 8 and the leaf securing member 18 from below. The guiding member 8 is located in a right-hand extreme position, which corresponds to a closure position of the leaf. The view of the leaf securing member 18 according to FIG. 8*b* shows that the control element 9 is located in the portion 10.2 of the control element 10. If the control element 9 is now displaced in the circumferential direction of the rebate, that is to say, displaced in an upward direction in accordance with FIG. 8*b*, the control element 9 reaches the region 10.1 of the control element 10, as shown in FIG. 9*b*. This leads to the guiding member 8 being displaced to the left, as can be seen in FIG. 9*a*. This position corresponds to a sliding position; this means that a leaf in this position can be displaced relative to the fixed surround.

Figure 10:
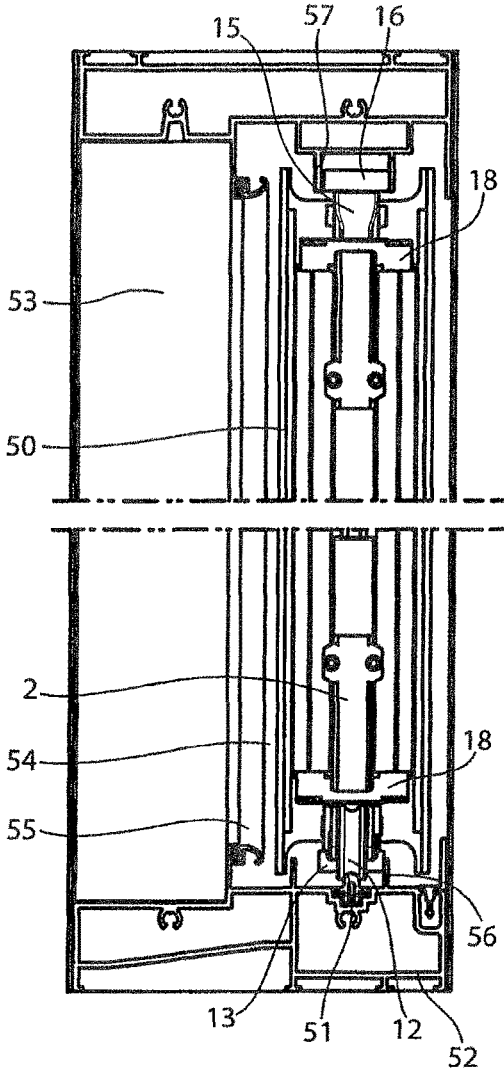
FIG. 10 is a view of a leaf from the closure side, wherein the leaf is arranged with spacing from a fixed surround.

FIG. 10 is a view of a window, a door or the like from the closure side. The actuation mechanism 2 is mounted on a leaf 50. This is supported via the roller arrangement 12 on a running rail 51 which is a component of a ground sill 52. Between the leaf 50 and a fixed frame 53, which in the same manner as the ground sill 52 is a component of a fixed surround, a gap 54 can be seen. The leaf 50 is accordingly not located on a circumference seal 55 which is arranged on the fixed frame 53. The roller 13 is in abutment with a guide 56 of the fixed surround, which guide is constructed as a vertical web. In the position shown, the leaf 50 can be displaced relative to the fixed frame 53, wherein the roller 13 can be supported on the guide 56 or can roll thereon.

In the upper region of the window, there is also provided on the fixed surround a guide 57 which is constructed in a groove-like manner in this instance. A roller 16 which is a component of a guiding member 15 is guided in the guide 57.

Figure 11:
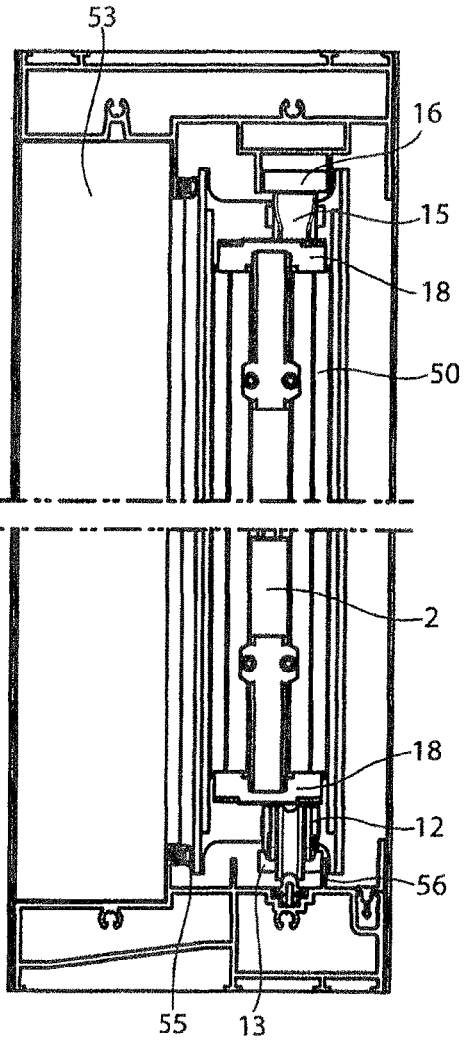
FIG. 11 is a view corresponding to FIG. 10, wherein the leaf has been displaced transversely relative to the main plane of the window or the door relative to the illustration according to FIG. 10.

If the actuation mechanism 2 is now actuated, the situation shown in FIG. 11 is produced. By actuating the actuation mechanism 2, the control elements 9, 17 are displaced, which leads to the roller arrangement 12 and accordingly the guiding member 8 being displaced relative to the leaf securing member 18 at the bottom on the leaf 50 and the guiding member 15 relative to the leaf securing member 18 at the top on the leaf 50. This means that the leaf 50 moves closer to the fixed frame 53 so that the seal 55 is clamped between the leaf 50 and the fixed frame 53. The leaf 50 is now in sealing abutment with the fixed frame 53. It can be seen here that the leaf 50 is pressed against the fixed frame 53 since the roller 13 is supported on the guide 56 or the roller 16 is supported on the guide 57, respectively. There are consequently no forces acting on the roller arrangement 12 transversely relative to the circumferential direction of the rebate.

What is claimed is:

1. A displacement arrangement for displacing a a sliding leaf of a window or of a door relative to a fixed surround of the window or the door in a direction which is transverse relative to a main plane of the window or the door, comprising:

an actuation mechanism arranged on the leaf and movable with at least one portion in a circumferential direction of a rebate; a first control element is arranged on the at least one portion of the actuation mechanism;

a second control element arranged on a guiding member; wherein the guiding member is configured to be guided on the fixed surround and moveable on the leaf transversely relative to a circumferential direction of the rebate, wherein one of the first and second control elements is constructed as a control contour which extends at least partially transversely relative to the circumferential direction of the rebate, wherein the other of the first and second control elements is constructed as a control projection which cooperates with the control contour, and wherein the guiding member has a roller that is rotatable about a rotation axis orientated perpendicularly to the circumferential direction of the rebate and parallel with a main plane of the window or the door and which is supported on a surround portion when the displacement arrangement is mounted, wherein the guiding member is arranged on a leaf securing member and wherein the leaf securing member has a longitudinal slot oriented in the circumferential direction of the rebate and through which the control projection protrudes, the longitudinal slot having a length that is substantially equal to a length of the control contour, the guiding member slidably engaging the leaf securing member to be moveable relative to the leaf securing member in the direction transverse to the plane of the window or door.

2. The displacement arrangement according to claim 1, wherein the leaf securing member has at least one transverse guide for the guiding member.

3. The displacement arrangement according to claim 2, wherein the at least one transverse guide comprises a dovetail.

4. The displacement arrangement according to claim 3, wherein the leaf securing member has a securing opening in a region of the dovetail guide.

5. The displacement arrangement according to claim 1, wherein the leaf securing member at least partially engages behind the guiding member.

6. The displacement arrangement according to claim 1, further comprising at least one roller arranged on the guiding member, via which the leaf of the window the door is supported on a running rail.

7. The displacement arrangement according to claim 6, further comprising a roller arrangement provided on the guiding member in a region of the roller to be pivotable about a horizontal axis orientated transversely relative to the circumferential direction of the rebate.

8. The displacement arrangement according to claim 7, wherein the roller arrangement is arranged on the guiding member with play in the transverse direction of the rebate.

9. The displacement arrangement according to claim 1, wherein the guiding member is preassembled with the leaf securing member and wherein the relative position of the guiding member and the leaf securing member is fixed by a fixing element.

10. A window or a door comprising the fixed surround, the leaf and the displacement arrangement according to claim 1.

11. The window or door according to claim 10, further comprising a circumference seal that is clamped between the leaf and the fixed surround in an event of a transverse displacement of the leaf.

12. The window or door according to claim 10, further comprising a plurality of guiding members.

* * * * *